United States Patent [19]

Vache

[11] 4,192,284

[45] * Mar. 11, 1980

[54] PORTABLE STOVES

[75] Inventor: Marcel Vache, Sainte-Foy-les-Lyon, France

[73] Assignee: Application des Gaz, Paris, France

[ * ] Notice: The portion of the term of this patent subsequent to Aug. 8, 1995, has been disclaimed.

[21] Appl. No.: 908,424

[22] Filed: May 22, 1978

Related U.S. Application Data

[63] Continuation-in-part of Ser. No. 722,901, Sep. 13, 1976, Pat. No. 4,105,013.

[51] Int. Cl.[2] ..... F24C 5/20; F24B 3/00; F23D 13/04

[52] U.S. Cl. ..... 126/38; 126/9 B; 126/9 R; 126/29; 126/30; 126/44; 431/344

[58] Field of Search ..... 126/38, 44, 9 R, 9 A, 126/9 B, 29, 30, 40, 50; 431/344

[56] References Cited

U.S. PATENT DOCUMENTS

| | | | |
|---|---|---|---|
| 2,154,305 | 4/1939 | Goerl | 126/38 |
| 2,397,766 | 4/1946 | Tullis | 126/38 |
| 2,465,572 | 3/1949 | Bramming | 126/44 X |
| 2,538,538 | 1/1951 | Stempel et al. | 126/38 |
| 2,853,126 | 9/1958 | Corlet | 126/38 X |

FOREIGN PATENT DOCUMENTS

| | | | |
|---|---|---|---|
| 566618 | 1/1945 | United Kingdom | 126/44 |

*Primary Examiner*—James C. Yeung
*Assistant Examiner*—Daniel J. O'Connor
*Attorney, Agent, or Firm*—Dowell and Dowell

[57] ABSTRACT

A portable stove of the type fuelled from a replaceable pressurized combustible gas cartridge which is secured inside a cover member supporting a burner head and having means for connecting the burner head to the replaceable cartridge. A pair of covers, which telescopically fit one into the other have the dual function of serving separately as saucepans or in co-operation as an expandible housing for storing the stove, the covers being selectively telescopable to relatively greater or lesser extents, respectively to store the stove assembled or alternatively disassembled. The stove has arms which are shaped so as to provide, when the arms are extended, upstanding portions which are inscribed in a circle whose diameter is greater than the external diameters of the covers.

3 Claims, 5 Drawing Figures

PORTABLE STOVES

FIELD OF INVENTION

The present invention is a continuation in part of my pending application No. 722,901 filed on September 13, 1976, now U.S. Pat. No. 4,105,013.

DESCRIPTION OF PRIOR ART

It is known to provide a pressure gasoline portable stove with a single cylindrical cover, the overall height of the device with the cover attached thereto being always the same.

It is also known to use such a cover as a saucepan.

In all prior portable stoves the length of the package when closed is always the same.

SUMMARY OF INVENTION

The present invention relates to portable stoves which are specially designed to provide minimum weight and bulk so that they can be conveniently carried on camping trips, walking-trips, etc. and used in other similar sportsman-type excursions. It is important to provide a simple design which maintains the dependability of the unit, and it is also important to provide a stove which can be folded to two degrees of compactness as the stove and gas cartridge are assembled or not during the course of the trip.

It will be noted that it is convenient and advantageous to have the parts of the stove nested in order to reduce their overall dimensions. Then it is necessary to have a limited number of parts, and to allow them to be nestable within a package.

Moreover it was also necessary to have a package which can be adapted to the other position of the stove i.e. when the parts of the stove are mounted on the gas cartridge.

It is an object of the present invention to provide for this purpose two telescopable containers usable as saucepans, with their openings facing each other, while they can take two telescoped portions corresponding respectively to:

On one hand the stove in completely dismounted condition, with the cartridge free (not yet pierced).

on the other hand the stove in operative configuration but with saucepan supporting arms in retracted position and the other parts assembled, one of the said parts being fitted to the cartridge.

Another object of the invention is to provide a stove comprising a dished member, a burner head, a cover member for securing the gas cartridge by means of a connecting element, which parts are nestable in such a manner that in the inoperative position the connecting element and the dished member are lying in the cover member.

BRIEF DESCRIPTION OF DRAWINGS

The invention will be best understood from the description which follows and from the accompanying drawings, which description and drawings, given particularly by way of indication, will also make apparent other advantages and objectives and also the important characteristics of the invention, of which the main ones are also defined in the accompanying claims.

DESCRIPTION OF PREFERRED EMBODIMENT

It is known that any portable stove, on which it is desired to heat a dish, has to comprise a support holding this dish above a source of heat, and which is able to ensure around the burner a sufficient circulation of gas to permit the arrival of combustion-assisting air and the discharge of the burnt gases.

The said support is made to comprise, at its rim, retaining means which are capable of limiting the lateral displacements of the dishes, so as to prevent them from losing their balance and falling off.

Figure 1:
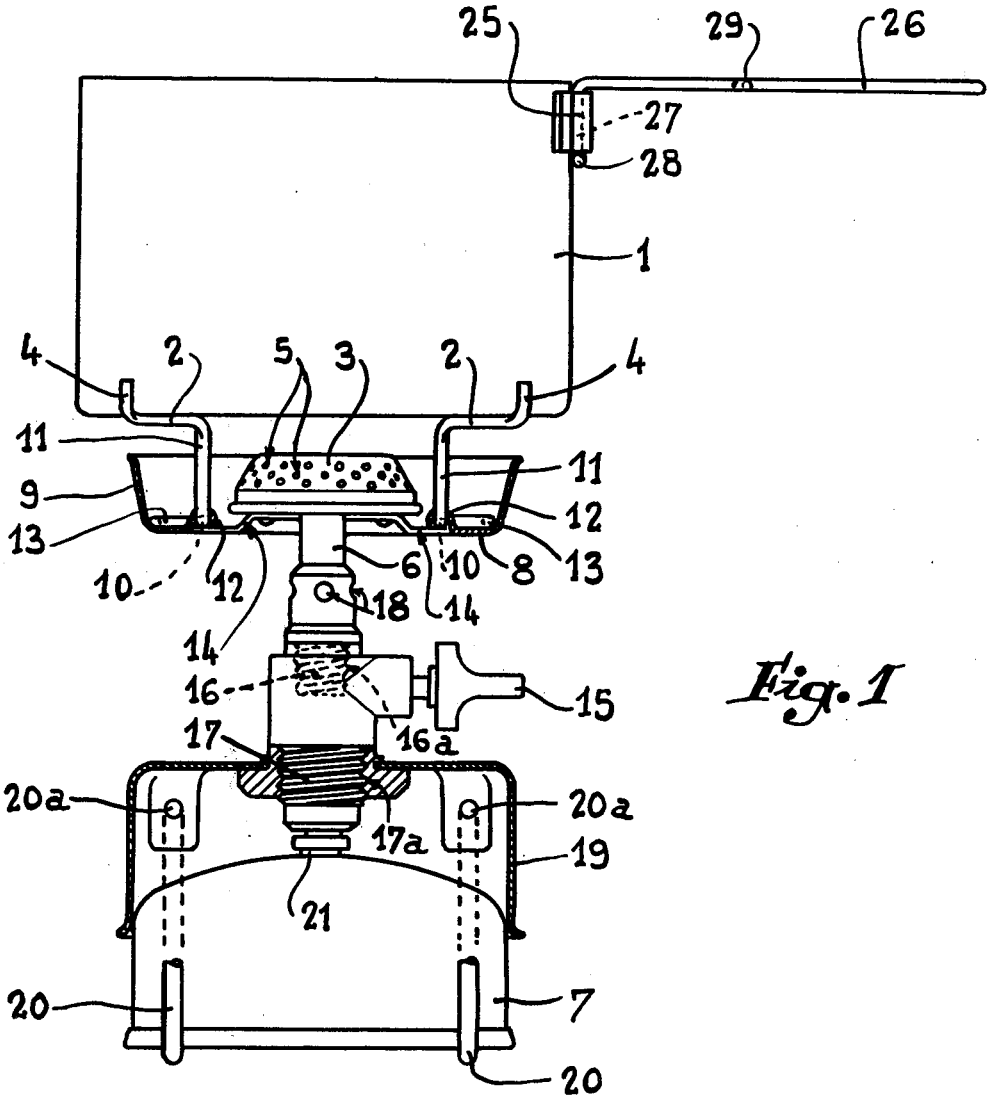
FIG. 1 is a diagrammatic view, partially in elevation and partially in section, of a stove according to the invention more particularly intended for excursions and represented in the fitted condition, ready for use.

The portable stove which is shown in FIG. 1, intended more particularly for excursions or touring, comprises a support formed by arms 2 which are substantially horizontal and divergent from a single burner 3 in order to support a dish or saucepan 1, these arms 2 having their ends turned upwardly so as to form claws 4 for holding the dish or saucepan 1.

In the example illustrated, the burner 3 is of mushroom head formation, comprising peripheral gas outlets 5 and a vertical coaxial tube 6 capable of receiving the gas under pressure coming from a cartridge 7 and mixing it with the air for combustion, entering radially through peripheral orifices.

The burner head 3 is fixed on the base 8 of a dished member, through the centre of which the tube 6 extends and of which the upwardly directed peripheral wall 9 forms a wind shield around the gas outlets 5.

Figure 2:
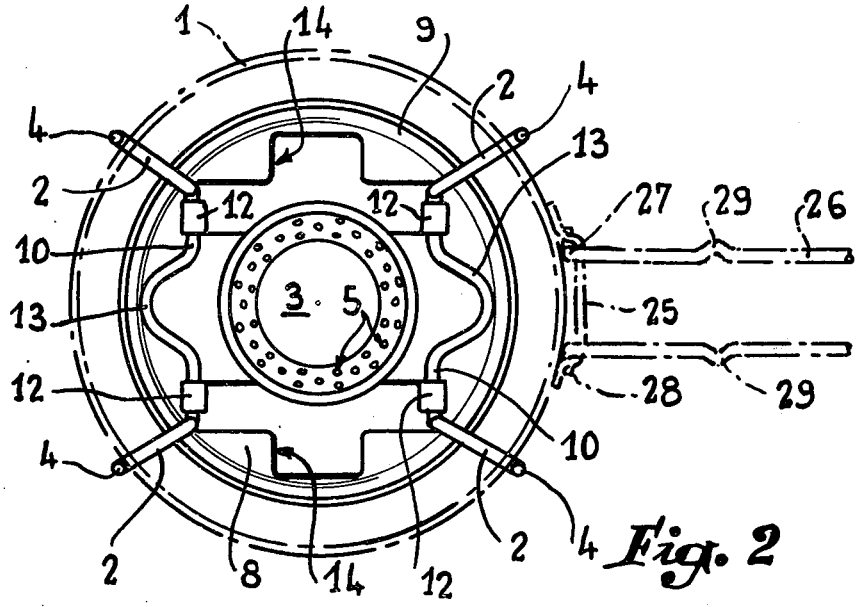
FIG. 2 represents the same stove, seen in plan view with the said utensils indicated in ghosted outline.
Figure 3:
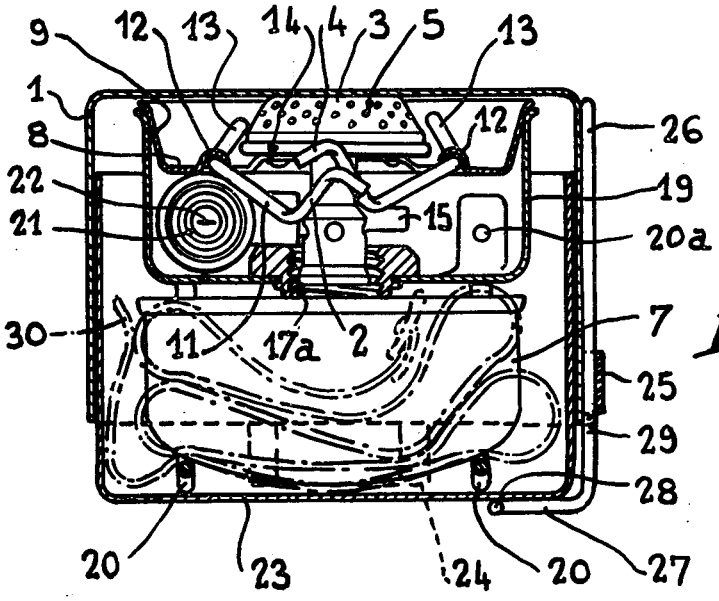
FIG. 3 is an axial section of the same stove, packed separately from the gas cartridge, in accordance with the invention, in two saucepans which serve as a casing or box for it.

The saucepan support is advantageously formed by complementary elements which are separately pivoted to the base 8 of the dished member so as to be able to pivot between two opposite positions: one position in which they extend above the peripheral wall 9, as can be particularly seen in FIG. 2, and another position in which they are brought back to the contour of the dished member for the storage of the stove, as can be seen more particularly in FIG. 3.

In the constructional form as illustrated, the dish support is formed by only two complementary elements, each forming a kind of stirrup or yoke pivoted in its middle part 10 on the bottom 8 of the dished member and comprising on either side of this part 10 two substantially symmetrical branches which are each composed, following it towards its free end, of sections which are substantially perpendicular to those which precede them: a first section 11 extending perpendicular to the section 10, that is to say, upwardly relatively to the bottom 8 of the dished member, until above the level of the upper rim of the peripheral wall 9, a section section 2 (to which reference has already been made above) extending perpendicular to the section 11, more or less radially and horizontally above the rim of the wall 9, and a third section 4 to which reference has also already been made above) directed more or less vertically upwards so as to form the peripheral holding means of the saucepan 1, horizontally on the section 2.

In the embodiment as illustrated, the said middle part comprises, between two rectilinear sections 10 which are coaxially aligned and engaged beneath lugs 12 cut out in the bottom 8 and surrounding the said sections 10 so as to serve as a pivoting means for them, an intermediate middle arch 13 which is curved towards the exterior around the burner 3, in a plane parallel to that containing the horizontal arms 2, the said arch 13 serving as a stop on the bottom 8 for preventing the said arms 2 from pivoting in the joints or lugs 12 beyond the horizontal position, as may be seen in FIGS. 1 and 2.

It will be noted that the stirrups or yokes 2, 4, 10, 11, 13 can be obtained economically and rationally from a round-section metal wire which is suitably bent and curved.

Furthermore, it is convenient to provide openings 14 in the bottom 8 of the dished member, which openings are so shaped as to be able to provide passage to at least a part of the two arms of each yoke, that is to say, in the example represented in FIG. 3, to the section 11 and to a part of the section 2 of these arms, so as to enable the yoke to be completely retracted beneath the plane passing through the upper edge or rim of the wall 9, which may be of small height, by effecting a simple pivotal movement towards the interior of the dished member on the rectilinear middle sections 12.

It is seen that, in the stove assembled as shown in Fig. 1, the openings 14 serve as an inlet for air for combustion, which ascends towards the burner 3, from whence the burnt gases continue to rise and pass over the base of the saucepan 11 before escaping radially through the annular gap maintained between the upper edge of the peripheral wall 9 of the dished member and the said base, because the latter is supported at a certain height above the dished member on the horizontal arms 2, of the aforesaid stirrups of yokes.

In the use of a touring stove of the type in question, the upwardly extending ends 4 of the horizontal arms 2 are contained within a circle having a diameter larger than the external circle of the base of the saucepan 1, of which the internal diameter is, in its turn, larger than the external diameter of the peripheral wall 9 serving as wind shield, this permitting the saucepan 1 to be used in combination with the other elements of the stove in order to serve as a packaging box or casing for it, as shown in FIG. 3.

To the parts as already described for forming the portable stove and adapted to be packed in the saucepan, it is appropriate also to add an intermediate cock-type connecting element 15 for shutting off and regulating the gas and coaxial threaded unions 16 and 17 for respectively connecting it in detachable manner to the tube 6 of the burner 8 by a tapping **16*a* and to the cartridge 7 by means of a cover member 19**.

Such a cover member 19 and its means for connecting it to a cartridge 7 have been described in detail in French Pat. No. 1,295,539, filed the 28th Apr. 1961.

This cover member 19 is designed in such a way as to be able to cap the cartridge 7 and to be engaged beneath its bottom by two stirrup members 20, pivoted at their ends, at **20*a*, to the periphery of the cover member 19**.

This latter is traversed coaxially by a tapped hole **17*a*, into which the union 17 can be screwed by its corresponding screwthread, so as to bear by an annular joint 21 against the cartridge 7 and to pierce the latter in known manner inside this fluid-tight joint by a coaxial pointed needle 22 of flat lancet form (FIG. 3**).

Figure 5:
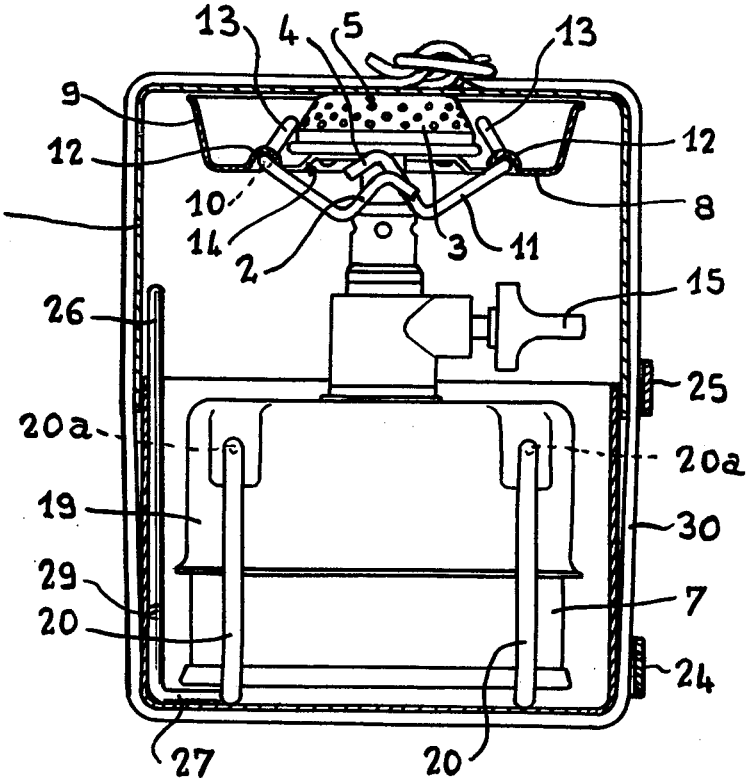
FIG. 5 is an axial section of the same stove packed in the same two saucepans, but this time mounted on its gas cartridge, bringing into effect the telescopic extensibility of the nesting of the saucepans in accordance with the invention.

Use is made of two deep cylindrical dishes or saucepans 1 and 23, which are capable of being nested telescopically to a greater or lesser extent on one another so as to be able to serve as a packaging case for the parts 2–22 which form the portable stove, either dismantled, with or without the gas cartridge 7, then offering a minimum space requirement (FIG. 3), or fitted and connected to the gas cartridge 7, the assembly then being of greater height (FIG. 5).

In the position which is shown in FIG. 3, which may be that in which the portable stove is offered for sale or even that when ready to start on an excursion, with a new cartridge 7 capable, if necessary, of being located between the yokes 20, the valve or cock 15 with the unions 16 and 17 is unscrewed and laid flat in the dished cover member 19, nested upside down beneath the shallower dished member 9, of which the central tapped hole **17*a*, with a diameter larger than that of the union 16**, is able to provide a free passage to this latter.

Figure 4:
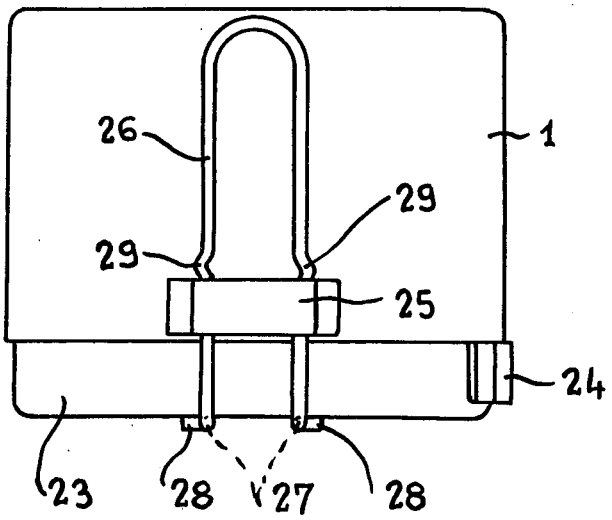
FIG. 4 is an external view of the assembly represented in FIG. 3, turned through 90° about its axis and making visible the detachable handle arranged according to the invention for serving as a closure means for this casing.

The dishes or saucepans 1 and 23 comprise guides 24, 25, respectively, at their periphery, one of them (23) at its free edge and the other (1) close to its base, as shown in FIG. 4, which guides are capable of providing a passage for a clip 26 which is curved substantially at right-angles in order to come into engagement with this curved portion on the bottom of the saucepan 1, so as to hold it nested beneath the saucepan 22, the said curved portion being moreover arranged so as to be capable of being engaged at will in the guide 24 or 25 of one or other of these saucepans 1 or 23, in order to fit it with a detachable radial handle, as can be seen particularly in FIG. 1.

The clip 26 is advantageously formed by a wire which has elastic flexibility and is shaped as a gripping device, of which the parallel end portions 27 are curved at a right-angle in order to extend in a flat position over the base of the saucepan 23 for a length corresponding to the height of the guides 24 and 25 and of which the ends 28 are bent over on the said base at a right-angle for diverging from one another.

Following the guide 24, the two parallel arms of the clip 26 form arched portions 29, which are outwardly curved, so as to be able to be engaged behind the guide 24, as may be seen in FIG. 4, thereby holding the assembly of the saucepans 1 and 23 in their mutual nesting position.

It is seen that, after the clip 26 has been withdrawn, it may easily be used as a detachable radial handle for one of the saucepans 1 or 23 by moving its free ends toward one another and causing them to pass through the corresponding guide 24 or 25, behind which the divergent ends 27 are resiliently engaged for locking this assembly.

The assembly may in addition be completed by a belt which is capable of being threaded through the guides 24 and 25 brought into alignment with one another on a single generatrix of the saucepans 1 and 23 which are nested one within the other in the position shown in FIG. 5, the detachable handle 26 then being inoperative, being placed inside the saucepans 1 and 23.

On the other hand, when the saucepans 1 and 23 are nested deeply one within the other and held in this nested position by the handle 26, as shown in FIG. 3, it is the belt 30 which, being inoperative, is placed inside the saucepans 1 and 23.

Thus it can be seen that a portable stove is obtained on which the saucepan is held in an extremely stable manner above the burner and which, when it is removed, can be packed with a minimum of size in the saucepans necessary for the use of said stove, which is very reliable in operation, broadly independent of the air currents and of which the weight can easily be brought to a minimum.

Furthermore, it has to be understood that the foregoing description has only been given by way of example and that it does not in any way limit the scope of the invention, from which there would be no departure if the constructional details as described are replaced by any other equivalents.

What I claim is:

1. A portable cooking apparatus fueled from a replaceable and pierceable combustible gas cartridge, comprising:

a dismountable stove for attachment to said cartridge, comprising:

a cover member shaped to receive said gas cartridge and means for securing said cartridge to said cover member, a burner head, an intermediate connecting element incorporating a cock, securable to said burner head and on said cover member, and having an element for connecting said burner head to said cartridge, support arms for holding a sauce-pan above the burner head;

two pans respectively supportable above the burner head and serving as saucepans when the stove is in use, and within which the stove when not in use is storable, said pans being capable of telescoping one within the other with one facing the other, and the pans being shaped so that they comprise storage means telescopable from a relatively lower height inactive position wherein the cover member, burner head and connecting element are dismantled from one another and nested one within another and in the two pans, and telescopable to a relatively higher height active position wherein the cover member, burner head and connecting element are fitted to one another and to a cartridge, and nested in the two pans.

2. A cooking apparatus according to claim 1, wherein a dished member is fixed to the burner head, and in the inactive position the connecting element is laid flat in the upside down cover member, while said dished member is nested in same upside down cover member.

3. A cooking apparatus according to claim 1, wherein the free ends of the support arms have a diameter larger than the external diameter of either pan.

* * * * *